US008453788B2

(12) United States Patent
Huettner et al.

(10) Patent No.: US 8,453,788 B2
(45) Date of Patent: Jun. 4, 2013

(54) IMPLEMENTING DYNAMIC NOISE ELIMINATION WITH ACOUSTIC FRAME DESIGN

(75) Inventors: Cary M. Huettner, Rochester, MN (US); Joseph Kuczynski, Rochester, MN (US); Robert Ernst Meyer, III, Oronoco, MN (US); Michael D. O'Connell, Rochester, MN (US); Timothy J. Tofil, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 156 days.

(21) Appl. No.: 12/943,115

(22) Filed: Nov. 10, 2010

(65) Prior Publication Data

US 2012/0111660 A1 May 10, 2012

(51) Int. Cl.

| | |
|---|---|
| ***G10K 11/04*** | (2006.01) |
| ***G10K 11/02*** | (2006.01) |
| ***G10K 11/172*** | (2006.01) |
| ***F01N 1/02*** | (2006.01) |
| *G10K 11/00* | (2006.01) |
| *G10K 11/16* | (2006.01) |
| *F01N 1/00* | (2006.01) |

(52) U.S. Cl.
USPC ..... 181/197; 181/196; 181/206; 381/71.5; 381/71.2

(58) Field of Classification Search
USPC ..... 181/196, 197, 224, 250, 258, 206, 181/225, 226, 241, 271, 277, 278; 381/337, 381/338, 347, 354, 71.5, 71.2, 71.3
See application file for complete search history.

(56) References Cited

U.S. PATENT DOCUMENTS

| | | | | | |
|---|---|---|---|---|---|
| 1,825,166 | A | * | 9/1931 | Sullivan | 181/145 |
| 1,969,704 | A | * | 8/1934 | D'Alton | 181/160 |
| 2,193,399 | A | * | 3/1940 | Fisher | 181/160 |
| 2,262,146 | A | * | 11/1941 | Massa | 381/338 |
| 2,739,659 | A | * | 3/1956 | Daniels | 381/338 |
| 3,777,844 | A | * | 12/1973 | Johnson | 181/199 |
| 3,826,333 | A | * | 7/1974 | Buckwalter | 181/153 |
| 4,027,116 | A | * | 5/1977 | Nakamura | 381/346 |
| 4,142,603 | A | * | 3/1979 | Johnson | 181/148 |
| 4,546,733 | A | * | 10/1985 | Fukami et al. | 123/184.57 |
| 4,555,598 | A | * | 11/1985 | Flanagan et al. | 381/338 |
| 4,800,983 | A | * | 1/1989 | Geren | 181/155 |
| 5,111,509 | A | * | 5/1992 | Takeuchi et al. | 381/338 |
| 5,315,661 | A | * | 5/1994 | Gossman et al. | 381/71.1 |

(Continued)

OTHER PUBLICATIONS

"Quarter Wave Tube", DiracDelta Science & Engineering Encyclopedia http://www.diracdelta.co.uk/science/source/q/u/quarter%20wave%20tube/source.html, printed Nov. 10, 2010.

(Continued)

*Primary Examiner* — Edgardo San Martin
(74) *Attorney, Agent, or Firm* — Joan Pennington

(57) ABSTRACT

A method, system and computer program product are provided for implementing dynamic noise elimination. A system frame includes a plurality of acoustical sensory devices monitoring the system for problem frequencies. The system frame includes a plurality of tubes. When the tube is open, airflow is allowed. When identified tubes are closed, quarter-wave-length attenuation is provided for a frequency in a range of frequencies, based upon a length of the tube when closed. Each of the plurality of tubes is selectively controlled to be operable open or closed at a particular length, responsive to identified problem frequencies.

20 Claims, 6 Drawing Sheets

U.S. PATENT DOCUMENTS

| | | | | |
|---|---|---|---|---|
| 5,317,112 | A * | 5/1994 | Lee | 181/250 |
| 5,333,576 | A * | 8/1994 | Verkleeren | 123/184.53 |
| 5,479,520 | A * | 12/1995 | Nieuwendijk et al. | 381/353 |
| 5,524,062 | A * | 6/1996 | Oh | 381/338 |
| 5,689,573 | A | 11/1997 | Jones | |
| 5,866,860 | A * | 2/1999 | Chen | 181/237 |
| 6,792,907 | B1 * | 9/2004 | Kostun et al. | 123/184.57 |
| 7,353,908 | B1 * | 4/2008 | French | 181/206 |
| 8,107,663 | B2 * | 1/2012 | Lin | 381/371 |
| 2009/0191076 | A1 * | 7/2009 | Deffenbaugh et al. | 417/540 |

OTHER PUBLICATIONS

Art Dudley, "Stereophile Listening #38" Feb. 2006, printed from http://www.audionut.net/documents/HorningPeriklesStphile.pdf.

* cited by examiner

IMPLEMENTING DYNAMIC NOISE ELIMINATION WITH ACOUSTIC FRAME DESIGN

FIELD OF THE INVENTION

The present invention relates generally to the data processing field, and more particularly, relates to a method, system and computer program product for implementing dynamic noise elimination with an acoustic frame design using quarter wavelength attenuation.

DESCRIPTION OF THE RELATED ART

Computer systems on the market today must meet certain acoustical requirements as set by various government agencies, and in additional optionally meet other acoustical requirements, such as set by the computer system manufacturer. In order to meet these requirements, companies must ensure that their systems do not violate preset noise thresholds. However, many systems today operate extremely close to those thresholds.

Some known computer systems now control fan speeds based upon many factors including component temperatures, which vary with work load, ambient temperatures, altitude and fail conditions.

In order to save on building cooling costs ambient temperatures are now allowed to rise which will result in higher fans speeds and noise levels. As system workloads reach peak, system fans speeds also rise increasing noise levels. When fan speeds rise a system may cross the threshold and violate required standards.

A need exists for an effective mechanism that monitors for dynamic events and adjusts noise abatement to compensate.

SUMMARY OF THE INVENTION

A principal aspect of the present invention is to provide a method, system and computer program product for implementing dynamic noise elimination. Other important aspects of the present invention are to provide such method, system, and computer program product substantially without negative effects and that overcome many of the disadvantages of prior art arrangements.

In brief, a method, system and computer program product are provided for implementing dynamic noise elimination. A system frame includes a plurality of acoustical sensory devices monitoring the system for problem frequencies. The system frame includes a plurality of tubes. When the tube is open, airflow is allowed. When identified tubes are closed, a quarter-wavelength attenuation is provided for a frequency in a range of frequencies, depending on a length of the tube when closed. Each of the plurality of tubes is selectively controlled to be operable open or closed at a particular length, responsive to identified problem frequencies.

In accordance with features of the invention, the plurality of acoustical sensory devices includes an array of microphones, for example, attached to a system frame aperture.

In accordance with features of the invention, a hinged flange is moved along the length of an identified tube for closing the tube, providing a selected tube length for quarter-wavelength attenuation of the identified problem frequency.

In accordance with features of the invention, the plurality of tubes is arranged in a tube array within the system frame. Tubes closest to identified problem frequencies are identified and selectively closed to negate the identified problem frequencies.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, with a plurality of tubes arranged in a tube array within a system frame, tubes closest to identified problem frequencies are identified and selectively closed to negate the identified problem frequencies and other tubes are opened to maintain a predefined threshold of open tubes, such as at least 50% open tubes for airflow. The tubes are adjustable quarter wavelength tubes for providing quarter-wavelength attenuation on a range of frequencies, depending on the length of the tube when closed.

Figure 1:
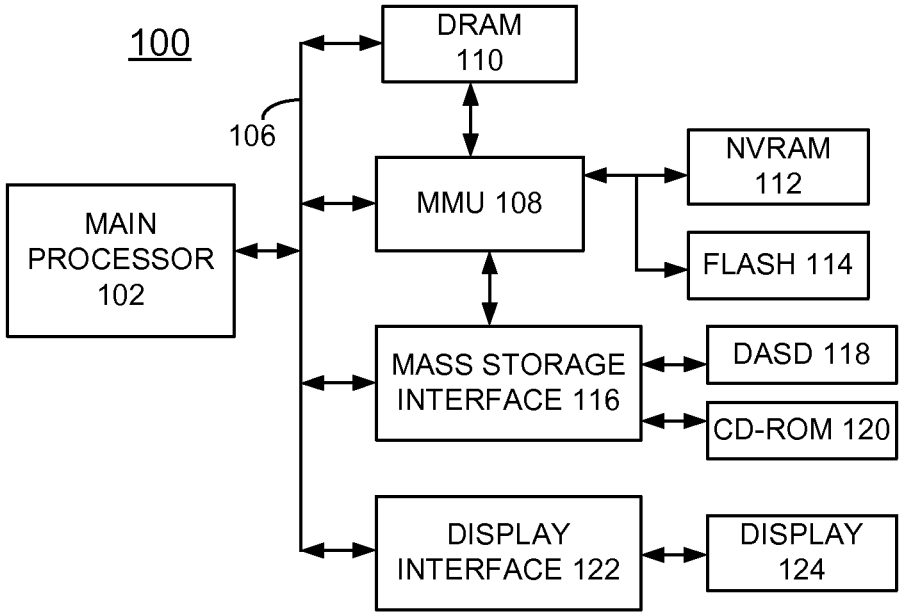
FIGS. 1 and 2 are block diagram representations illustrating an example computer system and operating system for implementing dynamic noise elimination in accordance with the preferred embodiment.
Figure 2:
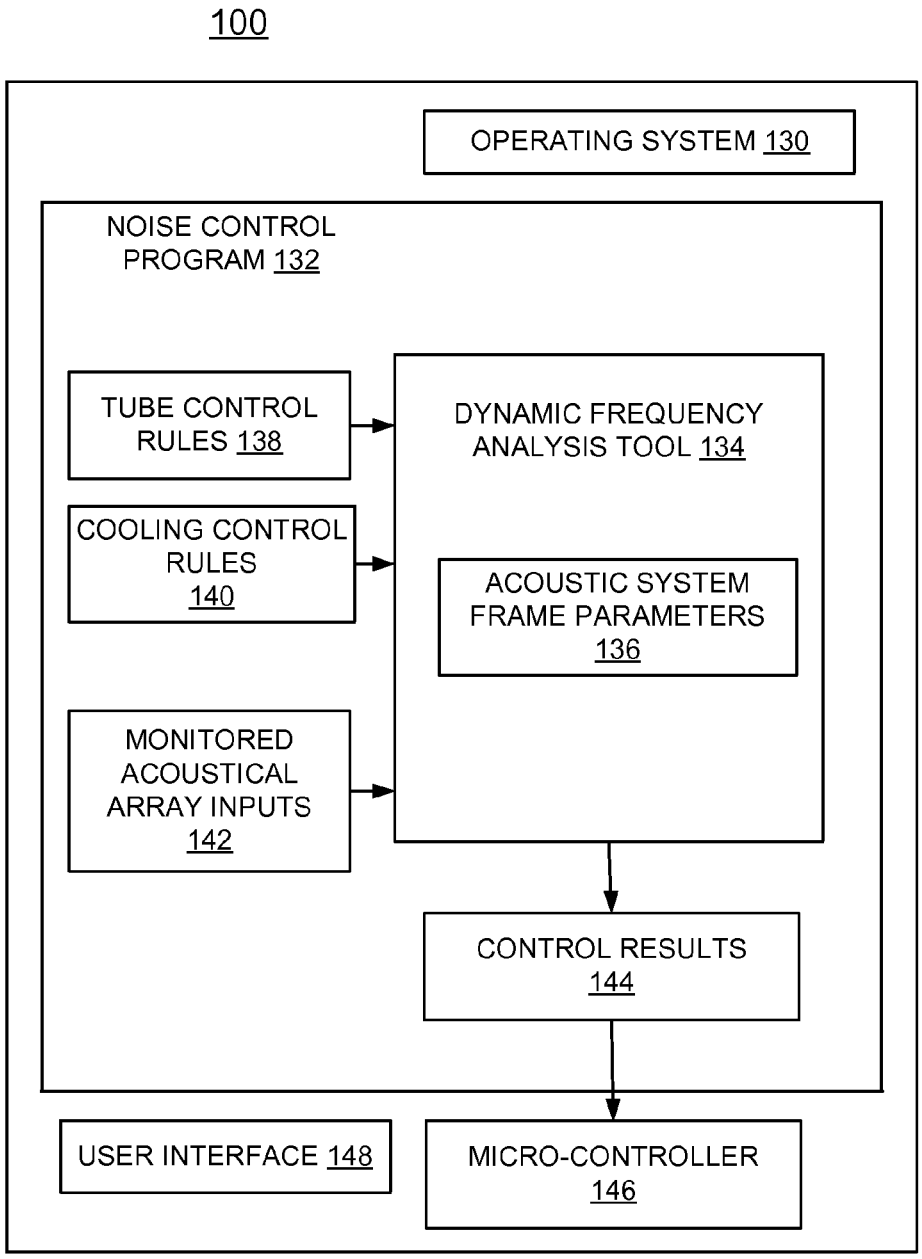

Referring now to the drawings, in FIGS. 1 and 2 there is shown an example computer system generally designated by the reference character 100 for implementing dynamic noise elimination in accordance with the preferred embodiment. Computer system 100 includes a main processor 102 or central processor unit (CPU) 102 coupled by a system bus 106 to a memory management unit (MMU) 108 and system memory including a dynamic random access memory (DRAM) 110, a nonvolatile random access memory (NVRAM) 112, and a flash memory 114. A mass storage interface 116 coupled to the system bus 106 and MMU 108 connects a direct access storage device (DASD) 118 and a CD-ROM drive 120 to the main processor 102. Computer system 100 includes a display interface 122 coupled to the system bus 106 and connected to a display 124.

Computer system 100 is shown in simplified form sufficient for understanding the present invention. The illustrated computer system 100 is not intended to imply architectural or functional limitations. The present invention can be used with various hardware implementations and systems and various other internal hardware devices.

As shown in FIG. 2, computer system 100 includes an operating system 130, a noise control program 132 of the preferred embodiment and a dynamic frequency analysis tool 134 of the preferred embodiment, a set of acoustic system frame parameters 136 including, for example, tube locations, and tube length parameters for quarter wavelength frequency attenuation, a set of tube control rules 138 of the preferred embodiment, a set of cooling control rules 140 describing, for example, a threshold value of open tubes for maintaining cooling air flow, a set of monitored acoustical array inputs 144 for identifying problem frequencies of the preferred embodiment, control results 144 coupled to a respective micro-controller or micro-actuator 146, for selectively opening and closing tubes of the preferred embodiment, and a user interface 148.

Various commercially available computers can be used for computer system 100. CPU 102 is suitably programmed by the noise control program 132 and dynamic frequency analysis tool 134 to execute the flowchart of FIG. 5 for implementing dynamic noise elimination in accordance with the preferred embodiment.

Figure 3:
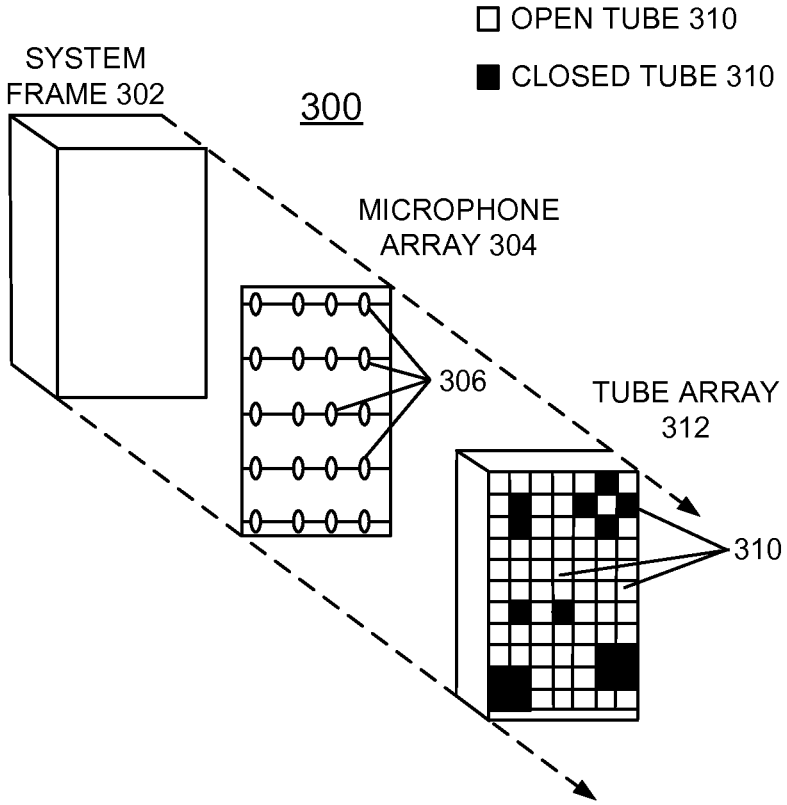
FIG. 3 illustrates example system enclosure or system frame apparatus for implementing dynamic noise elimination in accordance with the preferred embodiment.

Referring now to FIG. 3, there is shown an example system enclosure apparatus generally designated by the reference character 300 for implementing dynamic noise elimination in accordance with the preferred embodiment. System enclosure apparatus 300 includes a system frame 302 receiving a microphone array 304 including a plurality of microphones 306 or other acoustical sensory devices monitoring the system enclosure apparatus for problem frequencies. System enclosure apparatus 300 includes a plurality of tubes 310 arranged in a tube array 312 within the system frame 302.

As shown, selected tubes 310 are closed for implementing dynamic noise elimination with other tubes open allowing airflow through the system frame 302. The number of tubes 310 in the tube array 312 is provided based upon both the size of the system frame 302, and prior data on problem frequencies.

Figure 4:
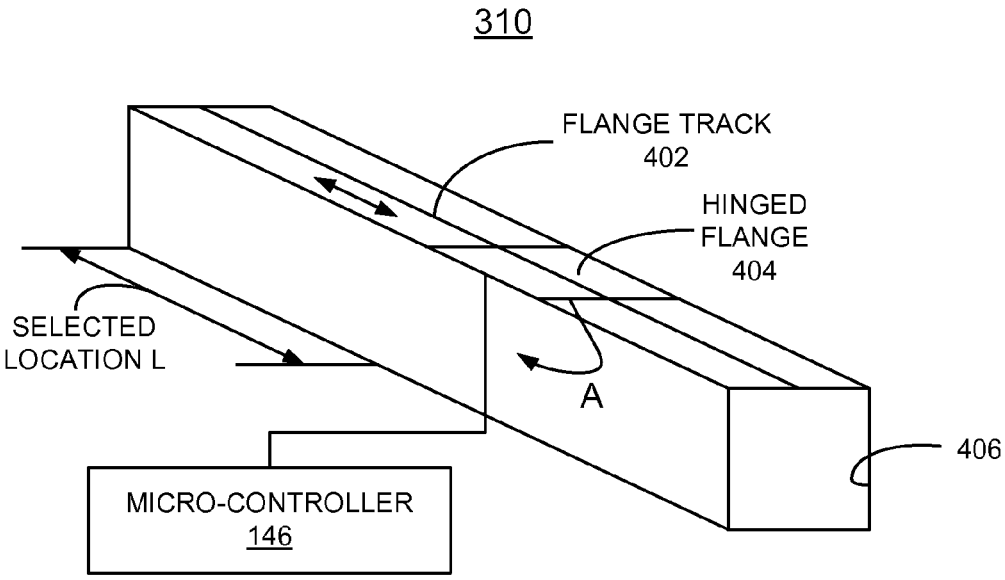
FIG. 4 schematically illustrates example tube apparatus for implementing dynamic noise elimination in accordance with the preferred embodiment.

FIG. 4 schematically illustrates an example tube 310 with the micro-controller 146 for implementing dynamic noise elimination in accordance with the preferred embodiment. A flange track 402 runs the length of the tube 310, along which moves a hinged flange 404. The flange 404 has the ability to rotate down and seal the entire aperture 406 of the tube at any point along the track 402.

In accordance with features of the invention, the tubes 310 utilize quarter wavelength attenuation techniques, in that the length of the closed tube equals one quarter of the wavelength of the offending frequency, effectively attenuating the noise from that frequency. The point of closure, for example, as indicated by an arrow labeled SELECTED LOCATION L is dynamically chosen through the use of the microphone array 304. The most offensive frequency near the location of a particular tube 310 is used to determine the location at which point the flange 404 closes. The problem frequencies typically fall into the range from 400 Hz to 4000 Hz.

A fundamental resonant frequency fr of a quarter wavelength attenuation tube 310 can be represented by:

$$fr=c/4L$$

where c represents the speed of sound [$ms^{-1}$], and L represents the selected tube length SELECTED LOCATION L determined from the location at which point the flange 404 closes.

For example, with an identified problem frequency of 1000 Hz, the tubes 310 closest to the problem frequency have their flanges moved and closed to create a resonator with length L=c/(4*1000), which equates to approximately 3.3 inches. This operation is repeated dynamically across the entire surface of the system frame 302 or door, while maintaining required airflow, for example with 50% airflow enabled by the threshold number of open tubes 310.

Each tube 310 has set dimensions, such as in a range from one inch (1") to 6 inches (6"), or more preferable 2"-5", or most preferably 3"-4" due to the mechanical and cost restrictions on the tube hardware, flange 404, micro-controller 146, and associated hardware. For example, nine (9) tubes 310 per square foot are provided within the tube array 312.

The illustrated tube 310 is shown as a rectangular tube; however, it should be understood that various shapes, such as hexagonal or circular can be used for the tubes 310. The overall length, width, and height of the tubes 310 are selected based upon the needs of a particular application.

Figure 5:
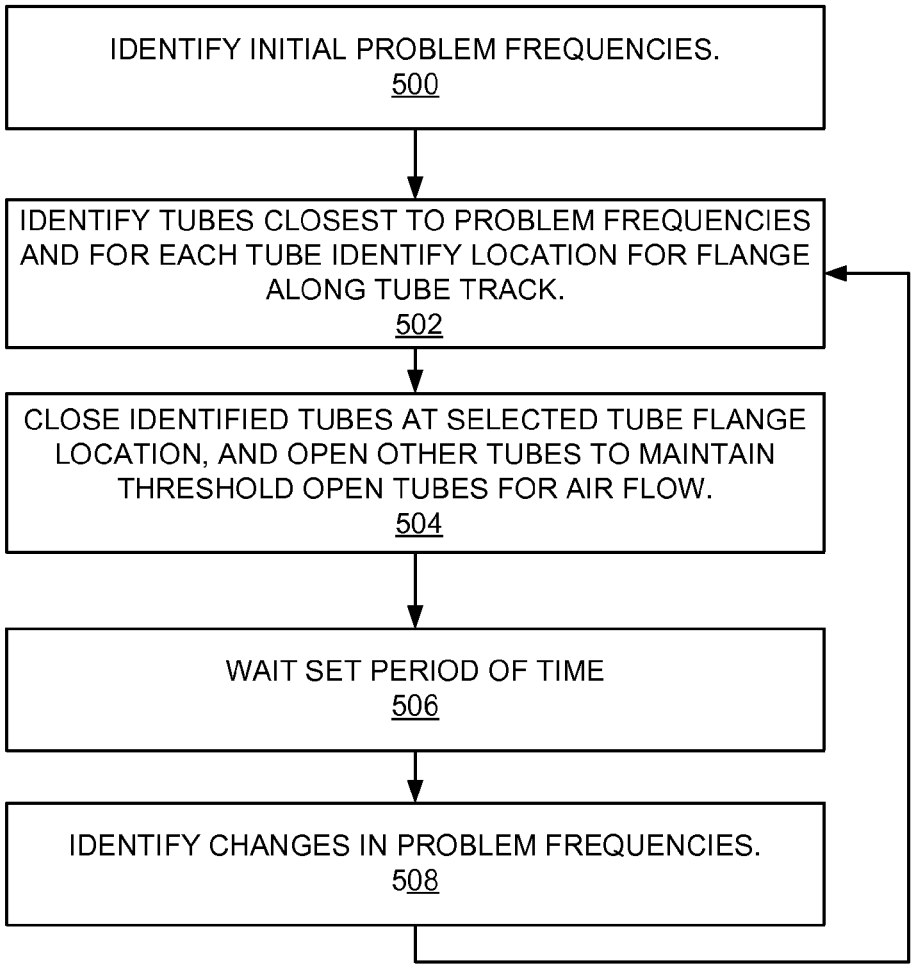
FIG. 5 illustrates exemplary sequential steps for implementing dynamic noise elimination in accordance with the preferred embodiment.

FIG. 5 illustrates exemplary sequential steps for implementing dynamic noise elimination in accordance with the preferred embodiment. During system operation, the microphone array 304 dynamically detects initial problem frequencies as indicated at a block 500. The tubes 310 are identified closest to the problem frequencies and for each of the identified tubes, the location to close the flange 404 along the tube track 402 is identified as indicated at a block 502. The micro-controller 146 closes the tubes 310 closest to the problem frequencies at the selected tube flange location, while opening others to maintain the predefined threshold, such as at least 50% open tubes for airflow as indicated at a block 504. Then a set delay period is provided as indicated at a block 506.

As indicated at a block 508, changes in the problem frequencies are identified, then the operations return to block 502. If a frequency is no longer detected as a problem, the system locates the next loudest frequency and adjusts the system accordingly. In this manner, fan speed changes, drive noise, or other infrequent but problematic noise sources are effectively negated, resulting in a better overall system acoustic performance.

Figure 6:
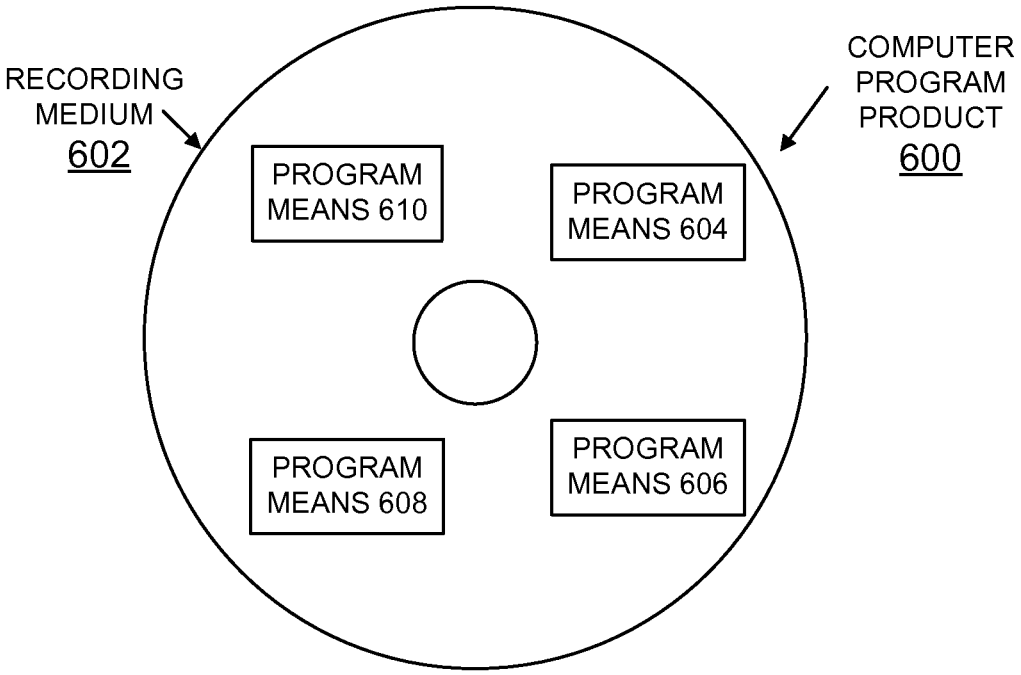
FIG. 6 is a block diagram illustrating a computer program product in accordance with the preferred embodiment.

Referring now to FIG. 6, an article of manufacture or a computer program product 600 of the invention is illustrated. The computer program product 600 includes a recording medium 602, such as, a floppy disk, a high capacity read only memory in the form of an optically read compact disk or CD-ROM, a tape, or another similar computer program product. Recording medium 602 stores program means 604, 606, 608, 610 on the medium 602 for carrying out the methods for implementing dynamic noise elimination of the preferred embodiment in the system 100 of FIGS. 1 and 2.

A sequence of program instructions or a logical assembly of one or more interrelated modules defined by the recorded program means 604, 606, 608, 610, direct the computer system 100 for implementing dynamic noise elimination of the preferred embodiment.

While the present invention has been described with reference to the details of the embodiments of the invention shown in the drawing, these details are not intended to limit the scope of the invention as claimed in the appended claims.

What is claimed is:

1. A system for implementing dynamic noise elimination comprising:

a system frame including an aperture;

a plurality of acoustical sensory devices for monitoring problem frequencies;

a plurality of tubes mounted in said system frame aperture;

during system operation, said plurality of acoustical sensory devices dynamically detecting problem frequencies;

a controller coupled to each of said plurality of tubes for selectively controlling each of said plurality of tubes to be operable open or closed, responsive to said detected problem frequencies; selectively identified ones of said tubes being closed for providing a quarter-wavelength attenuation of an identified problem frequency on a range of frequencies for each of said tubes being closed, based upon a dynamically selected length of each said tube when closed; and selected ones of said tubes being open for allowing airflow; and said controller waiting a set time period, and identifying changes in said detected problem frequencies; and said controller selectively controlling each of said plurality of tubes, responsive to said identified changes in said detected problem frequencies.

2. The system as recited in claim 1 wherein said plurality of acoustical sensory devices includes a microphone array including plurality of microphones associated with the system frame.

3. The system as recited in claim 1 wherein each of said plurality of tubes includes a movable flange being controlled by said controller to close the tube.

4. The system as recited in claim 1 wherein said each of said plurality of tubes includes a hinged flange movable along a flange track extending along a length of the tube, and rotated by said controller to close the tube.

5. The system as recited in claim 1 wherein said controller selectively closes identified tubes closest to the problem frequencies, while opening others to maintain a predefined threshold of open tubes for airflow.

6. The system as recited in claim 5 wherein said predefined threshold of open tubes for airflow includes at least 50% open tubes for airflow.

7. The system as recited in claim 1 wherein said controller identifies tubes closest to the problem frequencies, and for each identified tube said controller identifies a location along the tube length for closing each identified tube.

8. The system as recited in claim 1 includes memory storing acoustic frame system parameter data used for implementing dynamic noise elimination.

9. The system as recited in claim 1 includes memory storing tube control rules and cooling control rules, and said controller receiving monitored acoustical array inputs for implementing dynamic noise elimination, using said stored tube control rules and cooling control rules.

10. A computer-implemented method for implementing dynamic noise elimination in a system with a system frame including an aperture comprising:

providing a plurality of acoustical sensory devices for monitoring problem frequencies;

mounting a plurality of tubes in said system frame aperture;

during system operation, said plurality of acoustical sensory devices dynamically detecting problem frequencies;

selectively controlling each of said plurality of tubes to be operable open or closed, responsive to said detected problem frequencies; selectively identified ones of said tubes being closed; providing a quarter-wavelength attenuation of an identified problem frequency on a range of frequencies for each of said tubes being closed, based upon a dynamically selected length of each said tube when closed; and selected ones of said tubes being open for allowing airflow; and waiting a set time period, and identifying changes in said detected problem frequencies; and selectively controlling each of said plurality of tubes, responsive to said identified changes in said detected problem frequencies.

11. The computer-implemented method as recited in claim 10 wherein providing said plurality of acoustical sensory devices includes providing a microphone array including plurality of microphones associated with the system frame.

12. The computer-implemented method as recited in claim 10 includes providing a controller coupled to each of said plurality of tubes and providing each of said plurality of tubes with a movable flange being controlled by said controller to close the tube.

13. The computer-implemented method as recited in claim 11 wherein said movable flange includes a hinged flange movable along a flange track extending along a length of the tube, and rotating said hinged flange by said controller to close the tube at a selected location along the length of the tube.

14. The computer-implemented method as recited in claim 10 includes identifying tubes closest to the problem frequencies, and for each identified tube said controller identifying a location along the tube length for closing each identified tube.

15. The computer-implemented method as recited in claim 10 includes storing acoustic frame system parameter data used for implementing dynamic noise elimination.

16. The computer-implemented method as recited in claim 10 includes storing tube control rules and cooling control rules, receiving monitored acoustical array inputs and implementing dynamic noise elimination, using said stored tube control rules and cooling control rules.

17. A noise control computer program product for implementing dynamic noise elimination in a computer system with a system frame including an aperture, said noise control computer program product tangibly embodied in a machine readable medium used in the integrated circuit design process, said integrated circuit design computer program product including a dynamic frequency analysis tool, said noise control computer program product including instructions executed by the computer system to cause the computer system to perform the steps of:

providing a plurality of acoustical sensory devices for monitoring problem frequencies;

mounting a plurality of tubes in said system frame aperture;

during system operation, said plurality of acoustical sensory devices dynamically detecting problem frequencies;

selectively controlling each of said plurality of tubes to be operable open or closed, responsive to said detected problem frequencies; selectively identified ones of said tubes being closed; providing a quarter-wavelength attenuation of an identified problem frequency on a range of frequencies for each of said tubes being closed, based upon a dynamically selected length of each said tube when closed; and selected ones of said tubes being open for allowing airflow; and waiting a set time period, and identifying changes in said detected problem frequencies; and selectively controlling each of said plurality of tubes, responsive to said identified changes in said detected problem frequencies.

18. The noise control computer program product as recited in claim 17 includes identifying tubes closest to the problem frequencies, and for each identified tube said controller identifying a location along the tube length for closing each identified tube.

19. The noise control computer program product as recited in claim 17 includes providing a controller coupled to each of said plurality of tubes and providing each of said plurality of tubes with a hinged flange movable along a flange track extending along a length of the tube, and rotating said hinged flange by said controller to close the tube at a selected location along the length of the tube.

20. The noise control computer program product as recited in claim 17 includes storing acoustic frame system parameter data used for implementing dynamic noise elimination.

* * * * *